US011788226B2

(12) United States Patent
Deshmukh et al.

(10) Patent No.: US 11,788,226 B2
(45) Date of Patent: Oct. 17, 2023

(54) WATER RECIRCULATION INSERT FOR LAUNDRY APPLIANCE

(71) Applicant: Whirlpool Corporation, Benton Harbor, MI (US)

(72) Inventors: Rajwardhan Deshmukh, Maharashtra (IN); Arun Rajendran, St. Joseph, MI (US); Michael Vriezema, St. Joseph, MI (US); Jason R. Spears, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 209 days.

(21) Appl. No.: 17/338,948

(22) Filed: Jun. 4, 2021

(65) Prior Publication Data

US 2022/0389641 A1 Dec. 8, 2022

(51) Int. Cl.

| | |
|---|---|
| ***D06F 39/08*** | (2006.01) |
| ***D06F 23/02*** | (2006.01) |
| ***D06F 37/04*** | (2006.01) |
| ***D06F 37/22*** | (2006.01) |
| ***D06F 39/14*** | (2006.01) |

(52) U.S. Cl.

CPC ..... *D06F 39/083* (2013.01); *D06F 23/02* (2013.01); *D06F 37/04* (2013.01); *D06F 37/22* (2013.01); *D06F 39/14* (2013.01)

(58) Field of Classification Search

CPC ..... D06F 39/083; D06F 39/14; D06F 37/04; D06F 37/22; D06F 23/02

USPC ..... 68/12.19

See application file for complete search history.

(56) References Cited

U.S. PATENT DOCUMENTS 2,200,144 A * 5/1940 Zimarik ..... D06F 39/088 134/143

4,489,574 A 12/1984 Spendel

FOREIGN PATENT DOCUMENTS

| | | | |
|---|---|---|---|
| CN | 105332246 | A | 2/2016 |
| CN | 106702685 | A | 5/2017 |
| CN | 107938254 | A | 4/2018 |
| EP | 2392720 | A1 | 12/2011 |
| EP | 3613893 | A1 | 2/2020 |
| WO | 2009125952 | A2 | 10/2009 |
| WO | 2019201118 | A1 | 10/2019 |

OTHER PUBLICATIONS

European Search Report for European Application No. 22175581.2-1016, dated Nov. 4, 2022 (143 Pages).

* cited by examiner

*Primary Examiner* — Tinsae B Ayalew
(74) *Attorney, Agent, or Firm* — Harness, Dickey & Pierce PLC

(57) ABSTRACT

A laundry appliance including an appliance housing, a drum housing positioned in the appliance housing, and a drum that is configured to rotate inside the drum housing. A laundry compartment inside the drum is accessible through openings in the front of the appliance housing, drum housing, and drum. A front appliance door is pivotally connected to a front ring of the drum housing. A water recirculation insert is mounted to the front ring of the drum housing. The water recirculation insert includes a nozzle portion that extends through the front ring to a nozzle opening that is located inside the drum housing and configured to dispense recirculated fluid directly into the laundry compartment.

19 Claims, 4 Drawing Sheets

WATER RECIRCULATION INSERT FOR LAUNDRY APPLIANCE

FIELD

The present disclosure relates generally to laundry appliances and more particularly to a water recirculation insert for a front-load washer and dryer combination appliance.

BACKGROUND

The statements in this section merely provide background information related to the present disclosure and may not constitute prior art.

Laundry appliances (i.e., laundry machines, washing machines, and dryers) are prolific in both residential and commercial settings. Traditionally, separate washer and dryer machines have been used in tandem to clean and dry laundry. However, there is a growing market for washer and dryer combination appliances where a single machine performs both the washing and drying functions, thereby eliminating the need for two separate machines. There are a number of different names used to describe washer and dryer combination appliances, including without limitation, "washer/dryer combos" and "all-in-one washer dryers." While these units save space compared to separate washer and dryer machines, combining the washing and drying functions into a single appliance presents a number of engineering challenges.

Many washer and dryer combination appliances have a front-load appliance configuration, where the washer and dryer combination appliance includes an appliance housing with a front appliance opening that is accessed by a front-mounted appliance door. A drum is positioned in and is rotatable with respect to the appliance housing. During tumbling, a motor housed within the appliance housing rotates the drum. The drum typically has a front end with a drum opening that provides access to a laundry compartment inside the drum.

Front-load laundry appliances typically use less water compared to top-loading washing machines, where the laundry typically sits immersed in water during at least part of the wash cycle. By contrast, in front-load laundry appliances, the laundry repeatedly tumbles into water in the lower part of the drum and is then lifted back out of the water as the drum rotates during the wash cycle. To improve wash performance, water recirculation systems have been developed, which spray recirculated water onto the laundry as it tumbles within the rotating drum. The spray head in such systems is often mounted to the rubber bellow, which acts as a door seal. The washer and dryer combination appliance described herein does not have a rubber bellow, so an alternative mounting location and new spray head design had to be developed for this particular application.

SUMMARY

This section provides a general summary of the disclosure, and is not a comprehensive disclosure of its full scope or all of its features.

In accordance with one aspect of the present disclosure, a laundry appliance is provided, which includes an appliance housing with a front appliance opening, a front appliance door that is configured to open and close the front appliance opening, a drum housing mounted inside the appliance housing, and a drum positioned in and rotatable with respect to the drum housing. The drum includes a laundry compartment and a drum opening that provides access to the laundry compartment. The drum housing includes a front ring, a rear drum housing wall, and a drum housing sidewall that extends from the front ring to the rear drum housing wall to define a drum housing cavity therein. The front ring of the drum housing includes a front opening that is positioned in at least partial alignment with the front appliance opening and the drum opening to provide access to the laundry compartment inside the drum. A door seal is mounted to the front ring. The door seal is configured to contact and form a fluid-tight seal against the front appliance door when the front appliance door closes against the appliance housing. A water recirculation insert is mounted to the front ring of the drum housing. The water recirculation insert includes a nozzle portion that extends through the front ring to a nozzle opening that is located inside the drum housing cavity and configured to dispense fluid directly into the laundry compartment.

In accordance with one aspect of the present disclosure, the water recirculation insert includes a tubular portion that extends co-axially about a first axis and a nozzle portion that extends from the tubular portion to a nozzle opening along a second axis that intersects the first axis at an angle. The tubular portion includes an inlet end that is configured to be connected to a fluid supply conduit and an outlet end opposite the inlet end. The nozzle portion is connected to the outlet end of the tubular portion at an elbow. A lower flange extends outwardly from the nozzle portion at a location between the elbow and the nozzle opening and an upper flange extends outwardly from the tubular portion at a location between the inlet and outlet ends. The lower flange extends in a first plane and the upper flange extends in a second plane that is arranged at an angle relative to the first plane.

Advantageously, the water recirculation insert improves the wash performance of the laundry appliance described herein by dispensing recirculated fluid directly into the laundry compartment as the laundry tumbles within the rotating drum during a wash cycle.

BRIEF DESCRIPTION OF THE DRAWINGS

Other advantages of the present disclosure will be readily appreciated, as the same becomes better understood by reference to the following detailed description when considered in connection with the accompanying drawings wherein.

DETAILED DESCRIPTION

Figure 1:
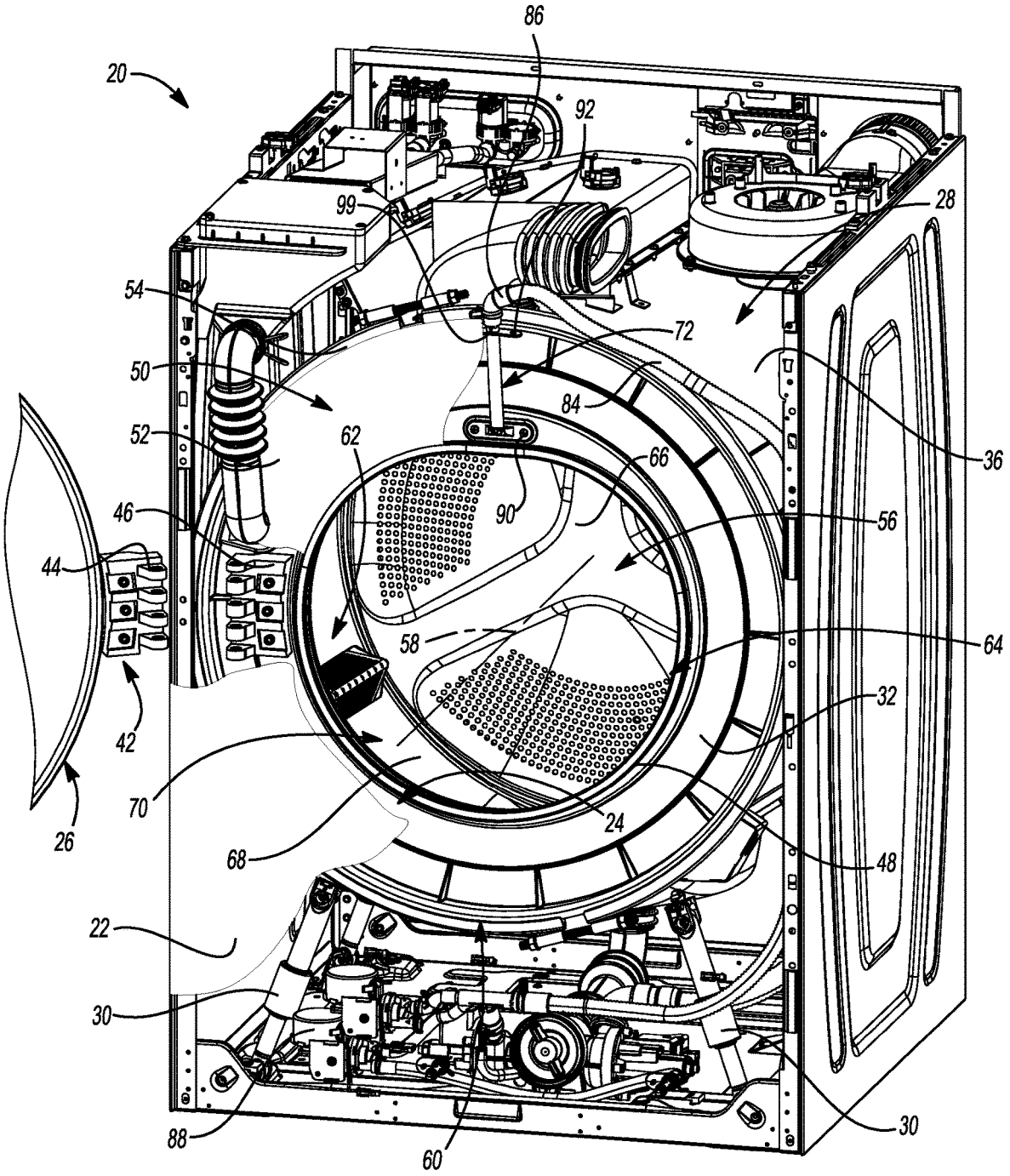
FIG. 1 is a front perspective view of an exemplary laundry appliance where the laundry appliance includes an appliance housing that has been partially removed in FIG. 1 to reveal several components of the laundry appliance, including a drum housing and a water recirculation insert.

Referring to the Figures, wherein like numerals indicate corresponding parts throughout the several views, a laundry appliance 20 is illustrated.

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

For purposes of description herein the terms "up," "down," "above," "below," "upper," "lower," "top," "bottom," "front," "rear," and derivatives thereof shall relate to the assembly as oriented in FIGS. 1-4. However, it is to be understood that the apparatus and assemblies described herein may assume various alternative orientations.

With reference to FIG. 1, a laundry appliance 20 having a front-load configuration is illustrated. The laundry appliance 20 includes an appliance housing 22 that is rectangular in shape and that includes a front appliance opening 24. As will be explained in greater detail below, a front appliance door 26 is pivotally connected to the laundry appliance 20. The front appliance door 26 swings between an open position and a closed position. In the closed position, the front appliance door 26 shuts or closes the front appliance opening 24 in the appliance housing 22.

Figure 2:
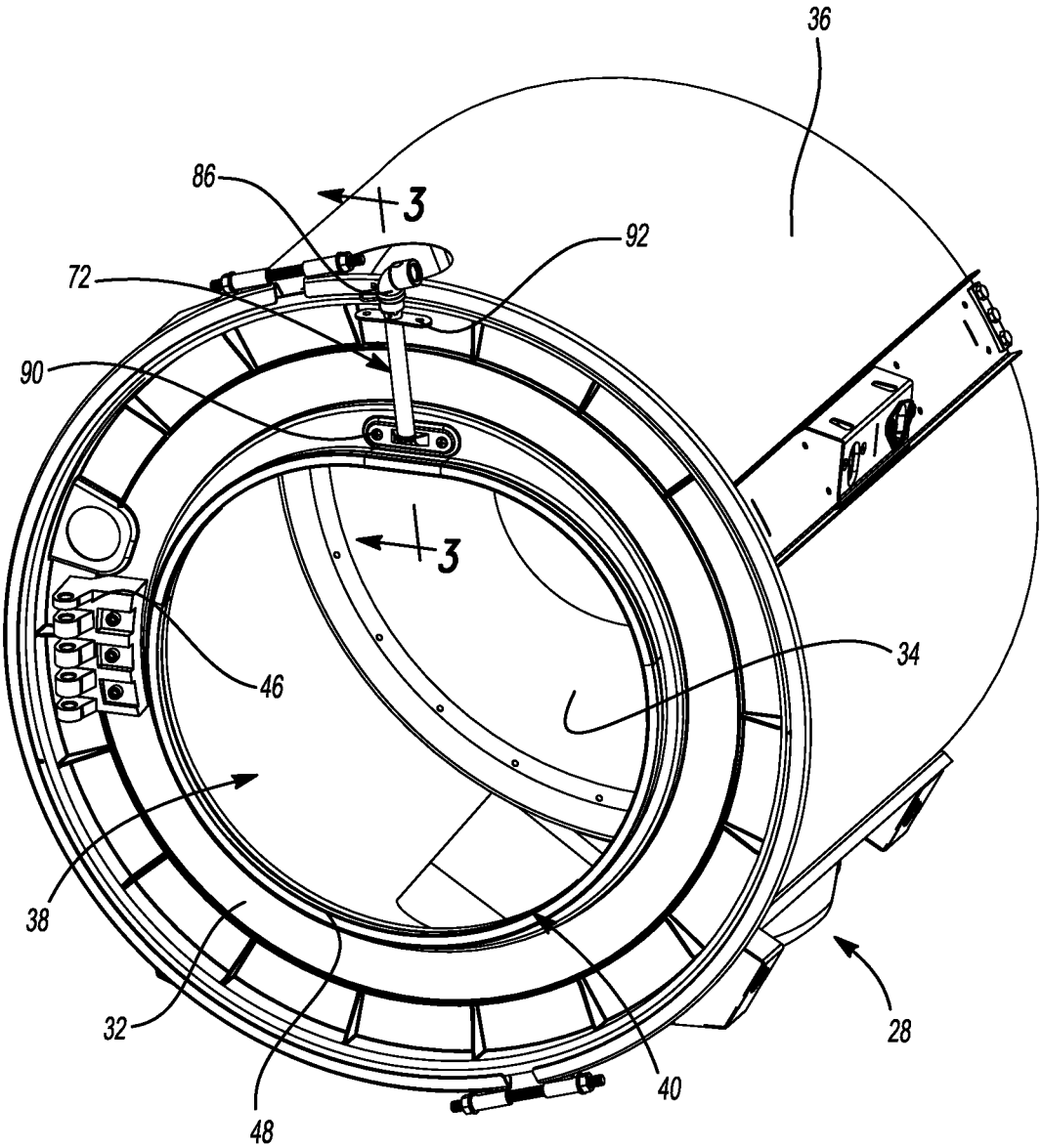
FIG. 2 is a front perspective view of the drum housing and water recirculation insert of the exemplary laundry appliance shown in FIG. 1.

With additional reference to FIG. 2, a drum housing 28 having a cylindrical shape is mounted inside the appliance housing 22 on dynamic mounts 30 that keep the drum housing 28 from rotating, but permit limited degrees of freedom that allow the drum housing 28 to move/oscillate relative to the appliance housing 22 during tumbling. The drum housing 28 includes a front ring 32, a rear drum housing wall 34, and a drum housing sidewall 36 that extends longitudinally from the front ring 32 to the rear drum housing wall 34 to define a drum housing cavity 38 inside the drum housing 28. The front ring 32 of the drum housing 28 includes a front opening 40 positioned in at least partial alignment with the front appliance opening 24. The front ring 32 is made of a rigid material. By way of example and without limitation, the front ring 32 is made of metal. The rigidity and strength of the front ring 32 is particularly important in the illustrated example because the front appliance door 26 is pivotally mounted to the front ring 32 of the drum housing 28 by a hinge 42. More specifically, the hinge 42 includes a first leaf 44 that is fixedly secured to the front appliance door 26 and a second leaf 46 that is fixedly secured to the front ring 32 of the drum housing 28. However, it should be appreciated that in an alternative configuration, the front appliance door 26 may be pivotally mounted to the appliance housing 22 instead of to the front ring 32 of the drum housing 28.

A door seal 48, mounted to the front ring 32, is configured to contact and form a fluid-tight seal against the front appliance door 26 when the front appliance door 26 is in the closed position. The drum housing 28 also includes a shroud 50 that covers at least part of the front ring 32. While the shroud 50 may be provided in a variety of different shapes, in the illustrated example, the shroud 50 has a front shroud wall 52 that is positioned between the front ring 32 and the appliance housing 22 and a side shroud wall 54 that extends between the front shroud wall 52 and the front ring 32 of the drum housing 28. Thus, the front ring 32 remains spaced from and does not contact the front appliance door 26 when the front appliance door 26 closes against the appliance housing 22.

A drum 56 is positioned in the drum housing cavity 38 and is supported therein such that the drum 56 is rotatable with respect to the drum housing 28 about a longitudinal axis 58. The drum 56 also has a cylindrical shape and extends longitudinally between a front drum end 60 and a rear drum end 62. The drum 56 includes a drum opening 64 at the front drum end 60, a rear drum wall 66 at the rear drum end 62, and a drum sidewall 68 that extends longitudinally between the front and rear drum ends 60, 62. The front drum end 60, the drum sidewall 68, and the rear drum wall 66 cooperate to define a laundry compartment 70 inside the drum 56. The appliance opening in the appliance housing 22, the front opening 40 in the front ring 32 of the drum housing 28, and the drum opening 64 at the front drum end 60 are at least partially aligned with one another and therefore provide access to the laundry compartment 70 inside the drum 56 when the front appliance door 26 is in the open position. Thus, it should be appreciated that in use, laundry (e.g., clothes, towels, and bedding) is placed inside the laundry compartment 70 where it is first cleaned during a wash cycle and then dried during a drying cycle.

A drive shaft (not shown), fixedly coupled to the rear drum end 62, is supported by a bearing pack (not shown) such that the drive shaft and the drum 56 rotate together as a single unit within the appliance housing 22. A motor (not shown) is positioned in the appliance housing 22 and is coupled to the drive shaft. The motor drives rotation of the drive shaft and the drum 56 relative to the drum housing 28 and the appliance housing 22 during operation of the laundry appliance 20, such as during washing and tumbling.

Figure 3:
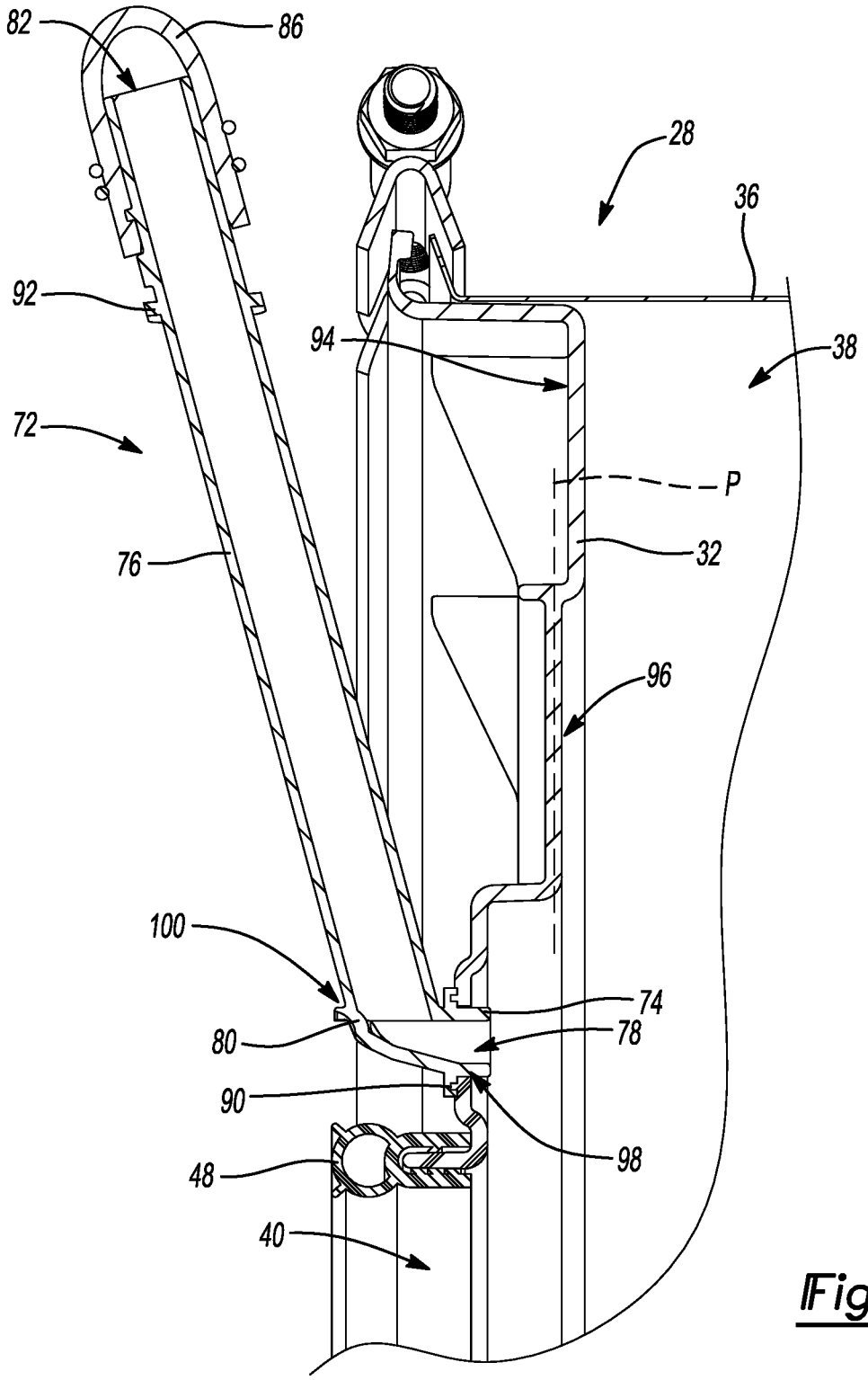
FIG. 3 is an enlarged side cross-sectional view of part of the drum housing and water recirculation insert of the exemplary laundry appliance shown in FIG. 1.
Figure 4:
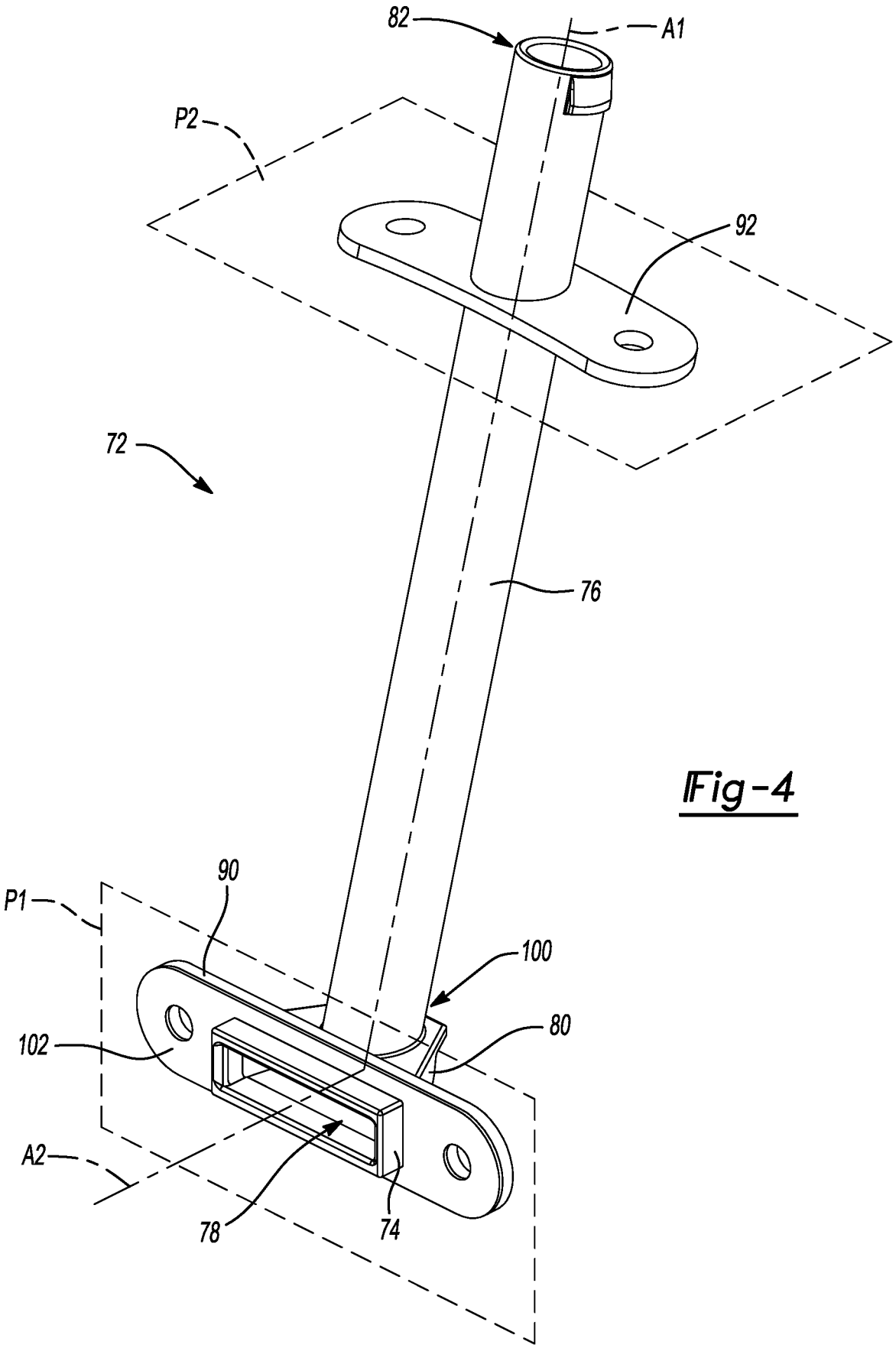
FIG. 4 is a front perspective view of the water recirculation insert of the exemplary laundry appliance shown in FIG. 1.

With additional reference to FIGS. 3 and 4, a water recirculation insert 72 configured to dispense fluid directly into the laundry compartment 70 is mounted to the front ring 32 of the drum housing 28 at a position that is located above the front opening 40 in the front ring 32 (i.e., at the twelve o'clock position when viewed from the front). The water recirculation insert 72 includes a nozzle portion 74 and a tubular portion 76. The nozzle portion 74 of the water recirculation insert 72 extends through the front ring 32 to a nozzle opening 78 that is located inside the drum housing cavity 38. The nozzle portion 74 also includes an elbow 80 and the tubular portion 76 that extends from the elbow 80 to an inlet end 82 that is configured to be connected to a fluid supply conduit 84 by a coupling 86. As best seen in FIG. 1, the fluid supply conduit 84 may be connected to a wash unit pump 88. During a wash cycle, the wash unit pump 88 operates to supply recirculated fluid (i.e., water and/or a water and detergent mix) to the fluid supply conduit 84 and ultimately the water recirculation insert 72. The recirculated fluid is then discharged through the nozzle opening 78 of the water recirculation insert 72, where it passes through the drum opening 64 and into the laundry compartment 70.

In the illustrated example, the water recirculation insert 72 includes a lower flange 90 and an upper flange 92. As best seen in FIG. 3, the front ring 32 includes a front surface 94 that faces the appliance housing 22 and a rear surface 96 that faces the drum 56. The front ring 32 extends in a plane P that is perpendicular to the drum housing sidewall 36 and includes a recirculation insert window 98. The nozzle portion 74 of the recirculation insert extends through the recirculation insert window 98 in the front ring 32 of the drum housing 28 and the lower flange 90 abuts the front surface 94 of the front ring 32. The lower flange 90 of the recirculation insert is secured to the front ring 32 of the drum housing 28 using fasteners, as an example. The nozzle portion 74 of the recirculation insert protrudes from the lower flange 90 and at least part of the nozzle portion 74 of the recirculation insert also protrudes from the rear surface 96 of the front ring 32 into the drum housing cavity 38.

As best seen in FIG. 1, a recirculation insert opening is provided in the side shroud wall 54. The tubular portion 76 of the recirculation insert extends through the recirculation insert opening 99 in the shroud 50 and the upper flange 92 abuts the side shroud wall 54. The upper flange 92 of the recirculation insert is secured to the side shroud wall 54 using fasteners, as an example.

As best seen in FIG. 4, the tubular portion 76 of the water recirculation insert 72 extends co-axially about a first axis A1 and linearly from the inlet end 82 to an outlet end 100 opposite the inlet end 82. The nozzle portion 74 of the water recirculation insert 72 is connected to the outlet end 100 of the tubular portion 76 at the elbow 80. The nozzle portion 74 extends from the elbow 80 to the nozzle opening 78 along a second axis A2 that intersects the first axis A1 at an angle. The lower flange 90 of the water recirculation insert 72 extends outwardly from the nozzle portion 74 in a first plane P1 that intersects the nozzle portion 74 of the water recirculation insert 72 at a location between the elbow 80 and the nozzle opening 78. The upper flange 92 of the water recirculation insert 72 extends outwardly from the tubular portion 76 in a second plane P2 that intersects the tubular portion 76 of the water recirculation insert 72 at a location between the inlet and outlet ends 82, 100. The second plane P2 and thus the upper flange 92 is arranged at an angle relative to the first plane P1 and thus the lower flange 90. Optionally, the lower flange 90 of the recirculation insert may include a flange seal 102 that contacts the front surface 94 of the front ring 32 to form a fluid-tight connection around the recirculation insert window 98 in the front ring 32 of the drum housing 28. While the water recirculation insert 72 may be made of a wide variety of different materials, in one preferred embodiment, the nozzle portion 74, tubular portion 76, elbow 80, lower flange 90, and upper flange 92 of the water recirculation insert 72 are integrally formed, made of a polymeric material, and the flange seal 102 is made of a co-molded rubber.

In the illustrated example, the laundry appliance 20 is a washer and dryer combination appliance that performs both a wash cycle and a drying cycle; however, it should be appreciated that the water recirculation insert 72 described herein may also be used in laundry appliances that only perform a wash cycle (i.e., in washing machines).

Many modifications and variations of the apparatus and assemblies described in the present disclosure are possible in light of the above teachings and may be practiced otherwise than as specifically described while within the scope of the appended claims. These antecedent recitations should be interpreted to cover any combination in which the inventive novelty exercises its utility.

What is claimed is:

1. A laundry appliance comprising:

an appliance housing with a front appliance opening;

a drum housing mounted inside said appliance housing, said drum housing including a front ring, a rear drum housing wall, and a side drum housing wall that extends from said front ring to said rear drum housing wall to define a drum housing cavity therein;

a drum positioned inside said drum housing and rotatably supported within said drum housing cavity such that said drum is rotatable relative to said drum housing, said drum including a laundry compartment located inside said drum and a drum opening that provides access to said laundry compartment;

said front ring of said drum housing including a front opening positioned in at least partial alignment with said front appliance opening and said drum opening;

a front appliance door pivotally mounted to said front ring of said drum housing such that said front appliance door is configured to swing between an open position and a closed position where said appliance door closes said front appliance opening; and a water recirculation insert mounted to said front ring of said drum housing, said water recirculation insert including a nozzle portion that extends through said front ring to a nozzle opening that is located inside said drum housing cavity and configured to dispense fluid directly into said laundry compartment.

2. The laundry appliance as set forth in claim 1, wherein said nozzle portion of said recirculation insert forms an elbow and said recirculation insert includes a tubular portion that extends from said elbow to an inlet end that is configured to be connected to a fluid supply conduit.

3. The laundry appliance as set forth in claim 2, wherein said front ring includes a front surface that faces said appliance housing, a rear surface that faces said drum, and a recirculation insert window and wherein said nozzle portion of said recirculation insert includes a lower flange that abuts said front surface of said front ring and that is fixedly secured to said front ring of said drum housing.

4. The laundry appliance as set forth in claim 3, wherein said lower flange of said recirculation insert includes a flange seal that contacts said front surface of said front ring to form a fluid-tight connection around said recirculation insert window in said front ring of said drum housing.

5. The laundry appliance as set forth in claim 3, wherein said nozzle portion of said recirculation insert protrudes from said lower flange and extends through said recirculation insert window in said front ring of said drum housing.

6. The laundry appliance as set forth in claim 3, wherein said drum housing includes a shroud that covers at least part of said front ring, said shroud including a front shroud wall positioned between said front ring and said appliance housing, a side shroud wall that extends from said front shroud wall to said front ring, and a recirculation insert opening in side shroud wall and wherein said tubular portion of said recirculation insert extends through said recirculation insert opening in said shroud and includes an upper flange that is fixedly secured to said side shroud wall.

7. The laundry appliance as set forth in claim 2, wherein said inlet end of said water recirculation insert is connected to said fluid supply conduit by a coupling.

8. The laundry appliance as set forth in claim 2, wherein said fluid supply conduit is connected to at least one wash unit pump that is configured to supply recirculated fluid to said fluid supply conduit.

9. The laundry appliance as set forth in claim 1, wherein said front appliance door is pivotally mounted to said front ring of said drum housing by a hinge that includes a first leaf that is fixedly secured to said front appliance door and a second leaf that is fixedly secured to said front ring of said drum housing.

10. The laundry appliance as set forth in claim 1, further comprising:

a door seal, mounted to said front ring, that is configured to contact and form a fluid-tight seal against said front appliance door when said front appliance door is in said closed position.

11. A laundry appliance comprising:

an appliance housing with a front appliance opening;

an appliance door configured to open and close said front appliance opening;

a drum housing mounted inside said appliance housing, said drum housing including a front ring, a rear drum housing wall, and a side drum housing wall that extends from said front ring to said rear drum housing wall to define a drum housing cavity therein;

a drum positioned inside said drum housing and rotatably supported within said drum housing cavity such that said drum is rotatable relative to said drum housing, said drum including a laundry compartment located inside said drum and a drum opening that provides access to said laundry compartment;

said front ring of said drum housing including a front opening positioned in at least partial alignment with said front appliance opening and said drum opening;

a door seal, mounted to said front ring, that is configured to contact and form a fluid-tight seal against said front appliance door when said front appliance door closes against said appliance housing; and a water recirculation insert mounted to said front ring of said drum housing, said water recirculation insert including a nozzle portion that extends through said front ring to a nozzle opening that is located inside said drum housing cavity and configured to dispense fluid directly into said laundry compartment, wherein said front ring remains spaced from and does not contact said front appliance door when said front appliance door closes against said appliance housing.

12. The laundry appliance as set forth in claim 11, wherein said recirculation insert includes a tubular portion that extends from said nozzle portion to an inlet end that is configured to be connected to a fluid supply conduit.

13. The laundry appliance as set forth in claim 12, wherein said front ring extends in a plane that is perpendicular to said side drum housing wall and includes a recirculation insert window and wherein said nozzle portion of said recirculation insert includes a lower flange that abuts and is fixedly secured to said front ring of said drum housing.

14. The laundry appliance as set forth in claim 13, wherein said nozzle portion of said recirculation insert protrudes from said lower flange and extends through said recirculation insert window in said front ring of said drum housing.

15. The laundry appliance as set forth in claim 12, wherein said drum housing includes a shroud covering at least part of said front ring, said shroud including a recirculation insert opening, and said tubular portion of said recirculation insert extends through said recirculation insert opening in said shroud and includes an upper flange that is fixedly secured to said shroud.

16. The laundry appliance as set forth in claim 11, wherein said recirculation insert extends through said front ring of said drum housing at a position that is located above said front opening in said front ring.

17. The laundry appliance as set forth in claim 11, wherein said front ring of said drum housing is made of metal.

18. The laundry appliance as set forth in claim 11, wherein said front appliance door is pivotally mounted to said appliance housing.

19. A water recirculation insert for dispensing recirculated fluid through an access opening to a laundry compartment of a front-load laundry appliance, said water recirculation insert comprising:

a tubular portion that extends co-axially about a first axis, said tubular portion including an inlet end that is configured to be connected to a fluid supply conduit and an outlet end opposite said inlet end;

a nozzle portion connected to said outlet end of said tubular portion at an elbow, said nozzle portion extending from said elbow to a nozzle opening along a second axis that intersects said first axis at an angle;

a lower flange that extends outwardly from said nozzle portion at a location between said elbow and said nozzle opening wherein said lower flange extends in a first plane; and an upper flange that extends outwardly from said tubular portion at a location between said inlet and outlet ends wherein said upper flange extends in a second plane that is arranged at an angle relative to said first plane.

* * * * *